US010868365B2

(12) United States Patent
Clark

(10) Patent No.: US 10,868,365 B2
(45) Date of Patent: Dec. 15, 2020

(54) COMMON GEOMETRY NON-LINEAR ANTENNA AND SHIELDING DEVICE

(71) Applicant: Earl Philip Clark, Darlington, IN (US)

(72) Inventor: Earl Philip Clark, Darlington, IN (US)

( * ) Notice: Subject to any disclaimer, the term of this patent is extended or adjusted under 35 U.S.C. 154(b) by 218 days.

(21) Appl. No.: 16/237,858

(22) Filed: Jan. 2, 2019

(65) Prior Publication Data

US 2020/0212562 A1 Jul. 2, 2020

(51) Int. Cl.

| | |
|---|---|
| ***H01Q 1/52*** | (2006.01) |
| ***H01Q 1/48*** | (2006.01) |
| ***H01Q 1/42*** | (2006.01) |
| ***H01Q 1/36*** | (2006.01) |

(52) U.S. Cl.

CPC ..... *H01Q 1/526* (2013.01); *H01Q 1/36* (2013.01); *H01Q 1/42* (2013.01); *H01Q 1/48* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,242,686 A | | 12/1980 | MacTurk | |
| 4,878,062 A | * | 10/1989 | Craven | H01Q 1/42 343/872 |
| 5,398,037 A | * | 3/1995 | Engheta | G01R 27/26 343/753 |
| 5,568,162 A | * | 10/1996 | Samsel | H01Q 1/526 343/726 |
| 5,815,120 A | * | 9/1998 | Lawrence | H01Q 1/2275 343/702 |
| 5,886,667 A | | 3/1999 | Bondyopadhayay | |
| 6,011,524 A | * | 1/2000 | Jervis | H01Q 1/42 343/859 |
| 7,002,526 B1 | | 2/2006 | Adams et al. | |
| 2004/0263418 A1 | * | 12/2004 | Kuroda | H01Q 3/06 343/909 |
| 2006/0022882 A1 | | 2/2006 | Gerder et al. | |
| 2006/0145940 A1 | * | 7/2006 | Kuroda | H01Q 15/14 343/911 R |

(Continued)

FOREIGN PATENT DOCUMENTS

| | | |
|---|---|---|
| CN | 101141021 | 3/2008 |
| CN | 104934703 | 9/2015 |

(Continued)

*Primary Examiner* — Graham P Smith
*Assistant Examiner* — Jae K Kim
(74) *Attorney, Agent, or Firm* — C. John Brannon; Brannon Sowers & Cracraft PC

(57) ABSTRACT

A portable common geometry non-linear antenna apparatus including a partially transparent housing defining a cavity, and a generally hemispherical antenna disposed within the cavity. The generally hemispherical antenna further includes an electrically conductive ground portion, an electrically conductive signal portion, an electrically insulating portion disposed between the electrically conductive ground and signal portions, and an electrically conducting mesh portion connected in electric communication with the signal portion. A first contact operationally connected to the ground portion and a second contact operationally connected to the signal portion. The electrically conductive mesh portion typically extends or bulges away from the electrically insulating portion to define a Faraday cage.

11 Claims, 3 Drawing Sheets

(56) References Cited

U.S. PATENT DOCUMENTS

| | | | | |
|---|---|---|---|---|
| 2007/0229374 | A1* | 10/2007 | Shimura | H01Q 1/42 343/713 |
| 2008/0030404 | A1 | 2/2008 | Irwin et al. | |
| 2010/0073239 | A1* | 3/2010 | Tatarnikov | H01Q 1/38 343/700 MS |
| 2010/0233421 | A1* | 9/2010 | Lind | E04B 1/3211 428/108 |
| 2010/0295749 | A1* | 11/2010 | Vanliere | H01Q 1/42 343/872 |
| 2013/0241785 | A1 | 9/2013 | De Flaviis et al. | |
| 2014/0118196 | A1* | 5/2014 | Koskiniemi | H01Q 19/106 343/702 |
| 2014/0168020 | A1* | 6/2014 | Stoytchev | H01J 5/54 343/721 |
| 2015/0340758 | A1* | 11/2015 | Wong | H01Q 1/273 343/718 |
| 2015/0346334 | A1* | 12/2015 | Nagaishi | H01Q 1/421 342/115 |
| 2016/0141747 | A1* | 5/2016 | Nance | H01Q 1/36 343/895 |
| 2016/0261035 | A1* | 9/2016 | Chamseddine | H01Q 9/40 |
| 2017/0271758 | A1* | 9/2017 | Nair | H01Q 19/021 |
| 2018/0166776 | A1* | 6/2018 | Ziegler | H01Q 1/362 |

FOREIGN PATENT DOCUMENTS

| | | |
|---|---|---|
| WO | 2007028902 | 3/2007 |
| WO | 2016061021 | 4/2016 |

* cited by examiner

COMMON GEOMETRY NON-LINEAR ANTENNA AND SHIELDING DEVICE

TECHNICAL FIELD

This novel technology relates generally to the field of radio communications, and, more particularly, to a portable antenna device for improving the frequency range of radio reception.

BACKGROUND

With the explosion of handheld electronic devices, such as smart phones, micro-computers, sensors, detectors, and the like, wireless communication of information to, from, and between such devices has become increasingly important. While most such devices come with built-in antennae, such antennae are typically mass produced and not designed to accommodate the specific functionality of the device. For example, many such devices alternately transceiver a variety of different types of data signals, such as voice, binary, and video signals, while the built-in antenna may be well suited for one of these types of transception, but not all of them. Thus, there is a need for portable antenna that may be operationally connected to a variety of devices and that can accommodate a variety of different types of signals. The present invention addresses this need.

DETAILED DESCRIPTION

Figure 1:
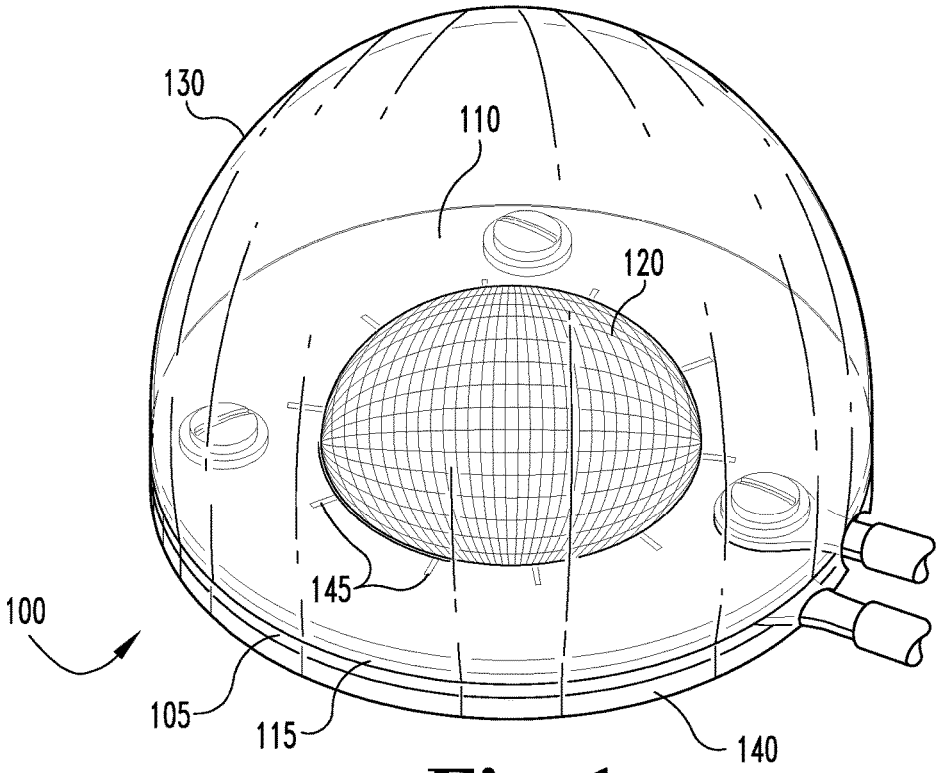
FIG. 1 is a first exploded view of a portable common geometry non-linear antenna according to a first embodiment of the present novel technology.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

Non-linear antennas allow enjoyment of the advantages of beam steering and beam forming across an array of nonlinear oscillators. Nonlinear antennas exploit two phenomena typically avoided in traditional linear antennas. The use of nonlinear unit cells along with interelement coupling allows for simplified dynamic control through the elimination of the need for phase shifters. By using nonlinear dynamics and avoiding a linear system constrained to linear quasi-steady state operation, increased bandwidth, phase and amplitude ranges, and coupling dynamics of nonlinear oscillator arrays may be exploited.

One major advantage of non-linear antenna design is the reduction in the required size and mass. For example, CETI uses a multi-frequency linear antenna with a very large (approximately fifty feet in length) parabolic dish for reflecting received signal onto the antenna for amplification. A very similar antenna design is employed by GOES for weather satellite reception. A non-linear antenna of the present novel technology enjoys similar multi-frequency signal reception functionality at a fraction of the size and mass of it linear counterparts.

Figure 2:
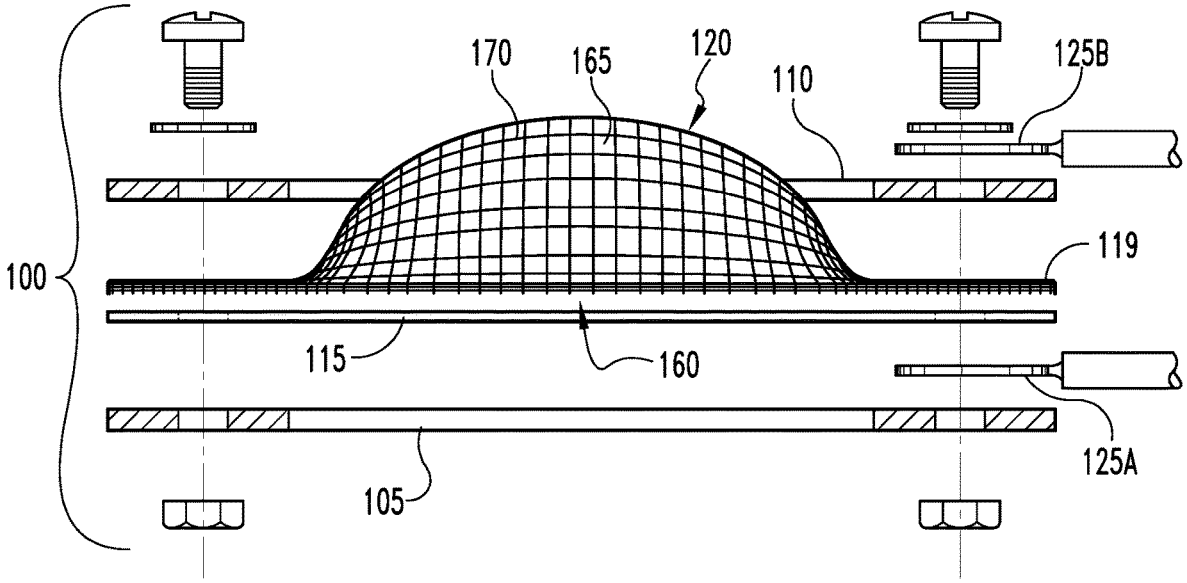
FIG. 2 is a perspective view of the embodiment of FIG. 1.
Figure 3:
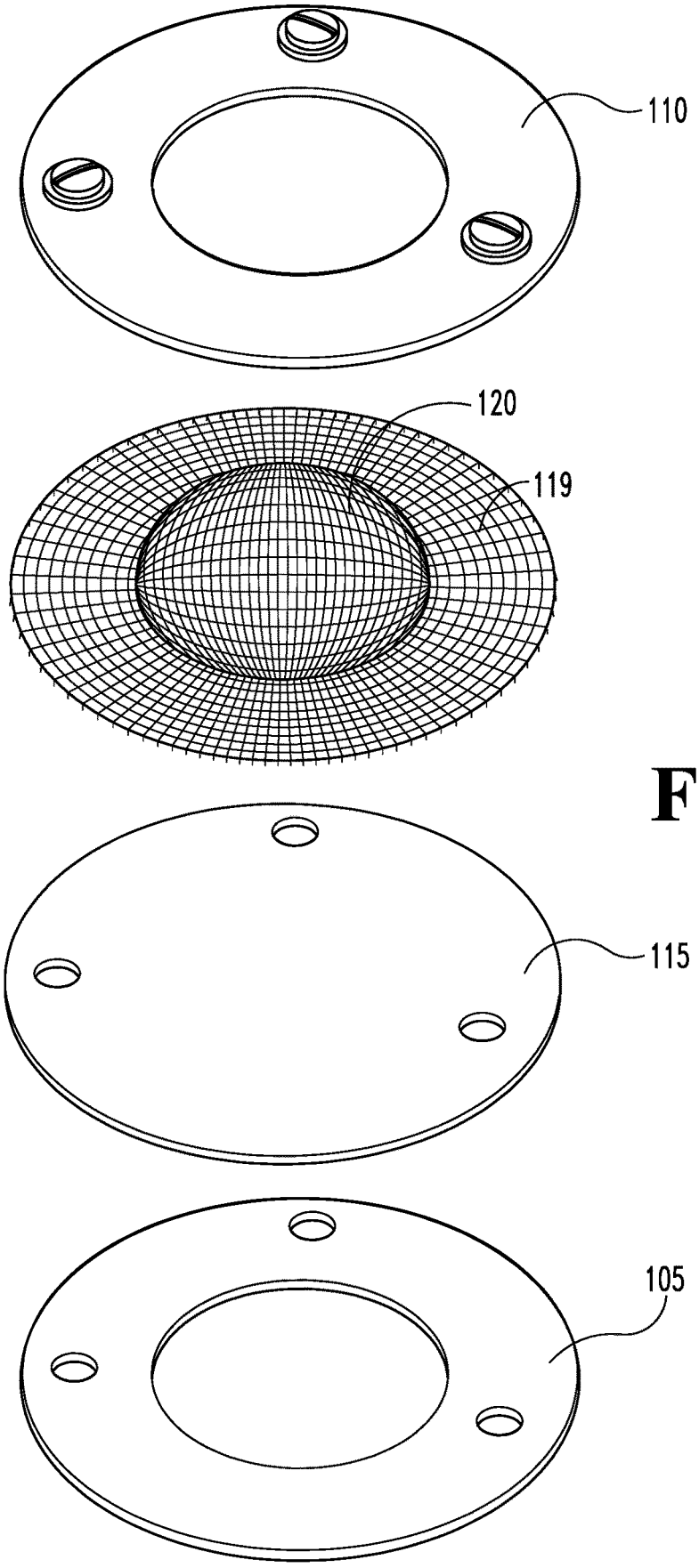
FIG. 3 is a schematic view of the embodiment of FIG. 1.
Figure 4A:
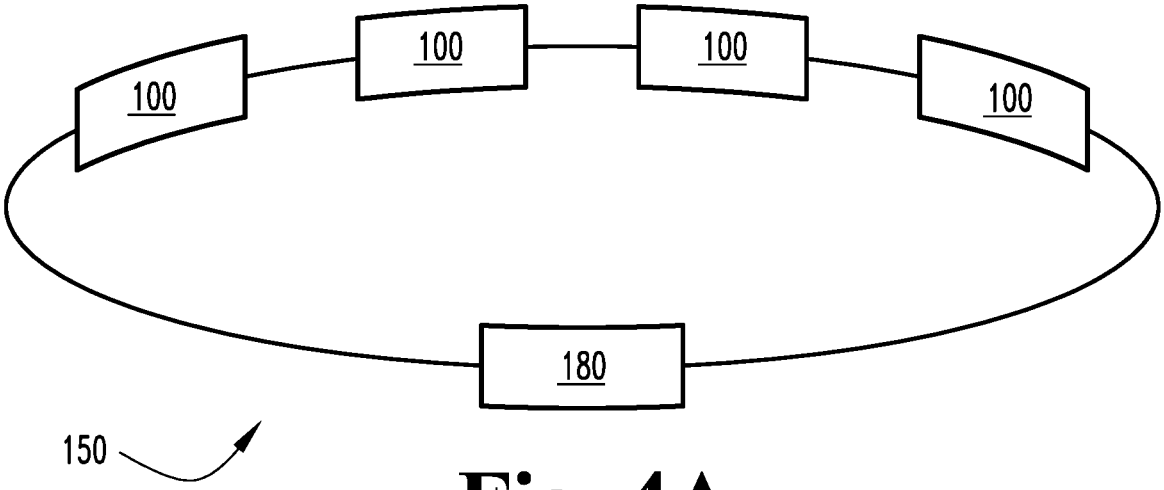
FIG. 4 is a schematic view of an array of antennae, each respective antenna of the embodiment of FIG. 1.
Figure 4B:
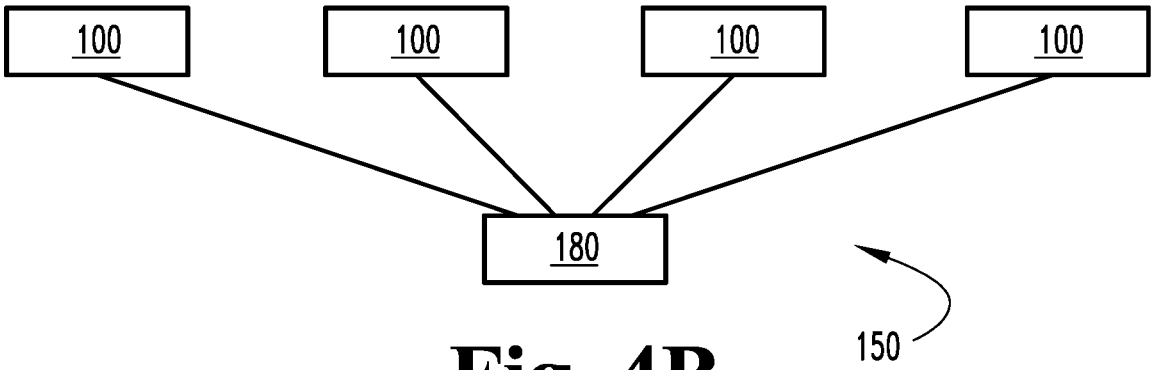
Figure 5:
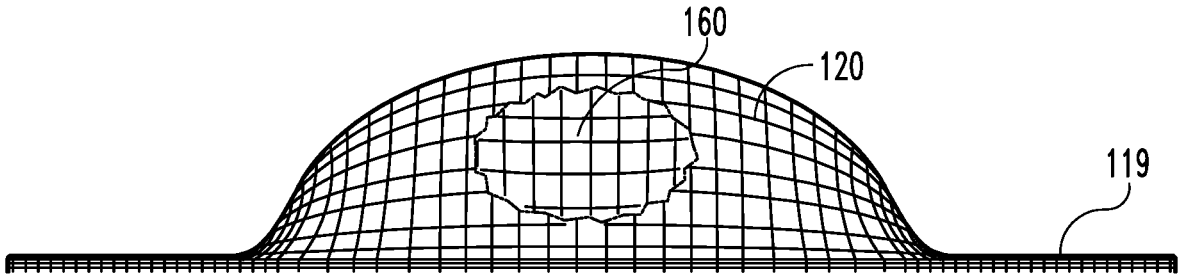
FIG. 5 is a schematic view of the shielding volume within an antenna of FIG. 1.

FIGS. 1-3 illustrate a first embodiment of the present novel technology, a portable common geometry non-linear antenna device 100. As seen in FIGS. 1-3, the antenna 100 includes an electrically conductive ground portion 105 (typically a ring or disk), an electrically conductive signal portion 110 (typically a ring), an insulating portion 115 positioned between the ground and signal portions 105, 110 (typically a disk or torus), and a generally disk-shaped electrically conductive mesh portion 119 connected in electric communication with the signal portion 110. The disk-shaped conductive mesh portion typically includes a hemispherical or distorted hemispherical bulge 120 extending outwardly or in a direction away from or opposite the insulating portion 115 and the ground portion 105 and defining an inner shielded volume. A first electrical contact or connector 125A is connected in electric communication with the ground portion 105, and a second electrical contact or connector 125B is connected in electric communication with the signal portion 110.

The electrically conductive components 105, 110, 119, 125 are typically non-ferrous and are more typically made of materials with similar, if not identical, electrical properties. Electrical components 105, 110, 119, 125 are typically disk-shaped, although one or more components 105, 110, 119, 125 may be missing a circular central portion to also be rings.

Some embodiments enjoy a protective casing 130 sized to at least partially enclose the above antenna device 100. The protective casing 130 is generally spherical or hemispherical, although it may assume any convenient shape. The protective casing 130 may be permanently affixed to a protective base member 140. While no practical restriction exists upon the size of the portable antenna apparatus 100, most often the portable antenna 100 is approximately palm size.

The protective casing 130 is typically made of an electrically insulating and non-magnetic material, or is at least sufficiently non-magnetic to minimize interference with the apparatus' 100 function. The protective casing 130 typically has a transparent portion allowing visual inspection of the contents thereof. The protective casing 130 is typically etched with graduated vertical and horizontal markings 145. Likewise, the protective base 140 may be etched with graduated vertical and horizontal markings 145 to help establish directionality. A portion of the graduated markings may include a phosphorescent substance for ease of reading. The phosphorescent substance may assist in the use of the antenna apparatus 100 in low light conditions.

The mesh portion 119 is electrically conductive and may be made of copper, aluminum, or like metal material. The mesh portion 119 may be woven or non-woven. The mesh portion 119 is typically disk-shaped with the bulge being typically hemispherical or semi-hemispherical in shape, and may have a distended or stupa-like shape. In one exemplary embodiment, the conductive mesh portion 119 is formed from woven copper ($C_{110}$) wire. For some applications, a woven wire mesh is preferred as the physics of EMF interaction lend themselves more towards the tubular conductors making up the three-dimensional woven wire mesh as opposed to the more two-dimensional shaped and perforated flat metal foil, sheet, or plate stock.

The antenna assembly 100 is typically used for single channel input. Arrays 150 of antenna assemblies 100 may be used to accommodate multiple-channel input applications. The configurations of these arrayed assemblies 150 may be specifically tailored for particular applications.

The interior space or pocket 160 defined by the mesh portion 119 of assembly 100 may be used as a Faraday cage to shield any item positioned therein from electrical or radio signals. When used as a shielding device, the assembly includes electrical and mechanical connection secured between the signal ring 110 and the ground ring 105, preventing emission of EMF and/or RF signals.

The hemispheric or quasi-hemispheric shape of the mesh portion 119 allow for interaction with a variety of frequencies, largely independent of antenna orientation. As illustrated in FIG. 2, the hemispherical (or quasi hemispherical) shape of the conductive mesh portion allows for interaction with a variety of frequencies as a function of the angle θ between the x-axis (time in seconds) and the y-axis (frequency in Hz). Other variables that may be manipulated to tune the interaction of the antenna 100 with the EM spectrum include the size and shape of the mesh gaps 165 and the coupling of the individual elements 170 making up the mesh.

In some embodiments, the mesh portion 120 is infiltrated with a structural material, such as resin, to help make the mesh portion more rigid in order to reinforce its hemispherical shape. In other embodiments, the mesh portion 119 is flexible and may be manipulated by the user.

In operation, the antenna 100 is of a convenient shape and size such that it is easily portable for the user. The antenna 100, once removed from its storage container or field pack, is operationally connected to any device that transmits or receives EM signals. If necessary, the antenna 100 may be oriented by a user in order to maximize signal reception or interaction. The antenna 100 may be held in the user's palm or, for convenience, be placed upon a surface and oriented as desired. Alternatively, the antenna device 100 can be semi-permanently mounted on the exterior or interior of a home, a cabin, or other suitable place.

The antenna device's 100 portable nature allows the antenna apparatus 100 to be easily transported and hence used during camping and hiking. The antenna apparatus' 100 low or no power requirements provide for the apparatus's use in post-disaster environments. For example, the antenna apparatus 100 may allow the transception of useful information in areas EM signal reception is normally unavailable and where mobile telephone reception is unavailable due to a lack of operational cell towers due to unavailability or damage.

Similarly, the antenna apparatus' 100 portability and wide transception frequency range allows for its use in remote areas and with watercraft. For example, the antenna apparatus 100 can be used on fishing boats, canoes, rafts, and the like. Thus, the antenna apparatus 100 provides for an enhanced transception ability typically not present in such remote areas and/or watercraft.

The following are some examples of the utility of the antenna system 100. The system 100 may be operationally connected to hand held or bench top electronic testing equipment, such as oscilloscopes, frequency analyzers, signal analyzers, and/or computerized waveform applications to allow for multi-frequency and/or band broadened transception. The antenna system 100 allows functionality throughout substantially the entire frequency spectrum, typically limited only by the tuning or bandwidth of the monitoring equipment, enabling a broader and more mobile means for testing, troubleshooting, and data collection.

In another embodiment, the antenna system 100 was dash-mounted in an automobile and operationally connected to a laptop computer to facilitate weather data collection.

In another embodiment, the antenna system 100 is operationally connected to one or more remote communication towers to route data collection/transmission operations therethrough. Likewise, the antenna system 100 may be used to route emergency calls, aircraft guidance and communications, with automated farm, agricultural, grading, and digging equipment and operations, and the like.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

The invention claimed is:

1. A portable common geometry non-linear antenna apparatus comprising:

a partially transparent housing defining a cavity; and a generally hemispherical antenna disposed within the cavity, wherein the generally hemispherical antenna further comprises:

an electrically conductive ground portion;

an electrically conductive signal portion;

an electrically insulating portion disposed between the electrically conductive ground and signal portions;

an electrically conducting mesh portion connected in electric communication with the signal portion;

a first contact operationally connected to the ground portion; and a second contact operationally connected to the signal portion;

wherein the electrically conductive mesh portion extends away from the electrically insulating portion.

2. The apparatus of claim 1, wherein the ground portion is a disk and the signal portion is a ring.

3. The apparatus of claim 1, wherein the ground portion is a ring, the insulating portion is a ring, the signal portion is a ring; and wherein the mesh portion defines an interior volume accessible through the ground portion, insulating portion, and signal portion.

4. The apparatus of claim 1 wherein the electrically conducting mesh portion is reinforced to secure its shape.

5. A common geometry non-linear antenna device, comprising:

an electrically conductive grounding disk member;

an electrically conductive signal disk member;

an electrically insulating disk member disposed between the electrically conductive ground and signal members;

a generally disk-shaped electrically conducting mesh member connected in electric communication with the signal portion;

a first contact connected in electric communication with the ground member; and a second contact connected in electric communication with the signal member;

wherein the electrically conductive mesh member has a central bulge extending away from the electrically insulating portion.

6. The antenna device of claim 5 and further comprising an at least partially transparent housing enclosing the electrically conductive grounding disk member, the electrically conductive signal disk member, the electrically insulating disk member, and the electrically generally disk-shaped electrically conducting mesh member.

7. The antenna device of claim 5 wherein the central bulge defines a Faraday cage.

8. The antenna device of claim 5 wherein the electrically conducting mesh member is shape reinforced.

9. A common geometry non-linear antenna system, comprising:

a plurality of common geometry non-linear antennas, each respective common geometry non-linear antenna further comprising:

an electrically conductive grounding disk member;

an electrically conductive signal disk member;

an electrically insulating disk member disposed between the electrically conductive ground and signal members;

a generally disk-shaped electrically conducting mesh member connected in electric communication with the signal portion;

a first contact connected in electric communication with the ground member; and a second contact connected in electric communication with the signal member;

wherein the electrically conductive mesh member has a generally hemispherical central bulge extending away from the electrically insulating portion;

wherein each respective common geometry non-linear antenna is operationally connected to a receiver.

10. The common geometry non-linear antenna system of claim 9 wherein the plurality of common geometry non-linear antennas are connected in parallel to the receiver.

11. The common geometry non-linear antenna system of claim 9 wherein the plurality of common geometry non-linear antennas are connected in series to the receiver.

* * * * *